US010535958B2

(12) United States Patent
Kondo et al.

(10) Patent No.: US 10,535,958 B2
(45) Date of Patent: Jan. 14, 2020

(54) CONNECTOR AND CONNECTION STRUCTURE OF CONNECTOR AND METAL CASING

(71) Applicant: HOSIDEN CORPORATION, Yao-shi, Osaka (JP)

(72) Inventors: Hayato Kondo, Yao (JP); Hiroie Yamaguchi, Yao (JP)

(73) Assignee: HOSIDEN CORPORATION, Yao-Shi, Osaka (JP)

( * ) Notice: Subject to any disclaimer, the term of this patent is extended or adjusted under 35 U.S.C. 154(b) by 0 days.

(21) Appl. No.: 16/007,406

(22) Filed: Jun. 13, 2018

(65) Prior Publication Data

US 2019/0006795 A1 Jan. 3, 2019

(30) Foreign Application Priority Data

Jun. 29, 2017 (JP) ..... 2017-127580

(51) Int. Cl.
*H01R 13/6594* (2011.01)
*H01R 13/6596* (2011.01)
(Continued)

(52) U.S. Cl.
CPC ..... *H01R 13/6594* (2013.01); *H01R 13/426* (2013.01); *H01R 13/50* (2013.01);
(Continued)

(58) Field of Classification Search
CPC ..... H01R 13/426; H01R 13/508; H01R 13/6594; H01R 24/50; H01R 2103/00;
(Continued)

(56) References Cited

U.S. PATENT DOCUMENTS 6,328,579 B1 * 12/2001 Mori ..... H01R 4/34 439/607.01
7,794,277 B1 * 9/2010 Peng ..... H01R 24/42 439/607.01

(Continued)

FOREIGN PATENT DOCUMENTS

EP 3086417 A1 10/2016
JP 2002-198117 A 7/2002

OTHER PUBLICATIONS

Extended European Search Report for European Application No. EP 18171478, published by the European Patent Office (EPO), dated Nov. 9, 2018, including corresponding Communication, 1-page Annex, Information on Search Strategy, and 5-page EPO Form 1703.

*Primary Examiner* — Travis S Chambers
(74) *Attorney, Agent, or Firm* — Kilyk & Bowersox, P.L.L.C.

(57) ABSTRACT

A connector including a shell, an inner body inside the shell, a terminal held by the inner body and disposed inside the shell, a ground terminal, and an outer body. The outer body includes a generally tubular first portion extending in a first direction, a second portion, and an accommodation space in the first and second portions securely accommodating the shell. The second portion is larger than the first portion in outer cross-sectional dimensions and/or wall thickness in the second direction orthogonal to the first direction. The second portion has a hole extending from an outer face of the second portion to the accommodation space. The ground terminal is in contact with, or contiguous with, the shell and is disposed in the hole of the outer body. The ground terminal includes a portion exposed from the outer body or partly located outside the outer body.

20 Claims, 9 Drawing Sheets

(51) Int. Cl.

| | |
|---|---|
| ***H01R 13/50*** | (2006.01) |
| ***H01R 13/426*** | (2006.01) |
| ***H01R 13/508*** | (2006.01) |
| ***H01R 24/50*** | (2011.01) |
| *H01R 103/00* | (2006.01) |

(52) U.S. Cl.
CPC ..... *H01R 13/508* (2013.01); *H01R 13/6596* (2013.01); *H01R 24/50* (2013.01); *H01R 2103/00* (2013.01)

(58) Field of Classification Search
CPC ..... H01R 13/6581; H01R 13/65802; H01R 13/658; H01R 13/6596; H01R 13/50; H01R 13/6593; H01R 24/40
USPC ..... 439/581, 607.01, 607.28, 939, 95, 101, 439/607.27
See application file for complete search history.

(56) References Cited

U.S. PATENT DOCUMENTS

| | | | | |
|---|---|---|---|---|
| 8,740,629 | B1 * | 6/2014 | Hall | H01R 13/6456 439/63 |
| 2002/0098737 | A1 * | 7/2002 | Koide | H01R 13/748 439/607.01 |
| 2016/0315427 | A1 * | 10/2016 | Kawakami | H01R 13/6594 |

* cited by examiner

CONNECTOR AND CONNECTION STRUCTURE OF CONNECTOR AND METAL CASING

CROSS-REFERENCE TO RELATED APPLICATION

The present application claims priority under 35 U.S.C. § 119 of Japanese Patent Application No. 2017-127580 filed on Jun. 29, 2017, the disclosure of which is expressly incorporated by reference herein in its entirety.

BACKGROUND OF THE INVENTION

Technical Field

The invention relates to a connector and a connection structure of the connector and a metal casing.

Background Art

Japanese Unexamined Patent Publication No. 2002-198117 discloses a conventional connector including a terminal, an inner body of an insulating resin, an electrically conductive shell, a tubular outer body of an insulating resin, and a ground terminal. The terminal is held in the inner body, which is securely accommodated in the shell, which is securely accommodated in the outer body. The outer body has an opening through which the shell is partially exposed. The ground terminal is attached to the outer body and is in contact with the shell through the opening. The ground terminal is connected to a metal casing to improve grounding of the shell inside the outer body.

SUMMARY OF INVENTION

The opening to receive the ground terminal is provided in the tubular portion of the outer body. This results in decreased strength of the tubular portion.

Under the circumstances, the invention provides a connector in which the tubular portion of the outer body has sufficient strength and the shell inside the outer body has improved grounding capability. The invention also provides a connection structure of such connector and a metal casing.

A connector according to an aspect of the invention includes a shell having electrical conductivity, an inner body made of an insulating resin and disposed inside the shell, a terminal held by the inner body and disposed inside the shell, a ground terminal, and an outer body made of an insulating resin. The outer body includes a first portion having a generally tubular shape and extending in a first direction, a second portion, and an accommodation space in the first and second portions. The accommodation space securely accommodates the shell. The second portion is larger than the first portion in outer cross-sectional dimensions in a second direction and/or in wall thickness in the second direction. The second direction is orthogonal to the first direction. The second portion is provided with an accommodation hole. The accommodation hole extends from an outer face of the second portion to the accommodation space. The ground terminal is in contact with, or contiguous with, the shell and is disposed in the accommodation hole of the outer body. The ground terminal includes a portion that is exposed from the outer body or partly located outside the outer body.

In the connector of this aspect, the accommodation hole for accommodating the ground terminal is provided in the second portion of the outer body, not in the generally tubular first portion. The first portion of the outer body thus retains sufficient strength. Further, as the ground terminal in the accommodation hole has the exposed or protruded portion, which can be brought into electrical connection with a metal casing of an electronic device so as to improve grounding of the shell inside the outer body.

The ground terminal may include a first connection portion, a second connection portion, and a junction. The first connection portion may be in contact with, or contiguous with, the shell. The first connection portion may be accommodated in the accommodation hole of the outer body. The second connection portion may be disposed on the first portion of the outer body. The junction may extend from the first connection portion to the second connection portion. In the connector of this aspect, as the second connection portion of the ground terminal is located on the first portion of the outer body, the second connection portion can be readily brought into contact and electrical connection with a metal casing of an electronic device.

The first connection portion may include a contact portion and a connection end portion. The contact portion may be in contact with the shell. The connection end portion may be connected to the junction. The connection end portion may be located farther from the shell than the contact portion is.

The second connection portion may be located farther from the shell than the contact portion of the first connection portion is, and closer to the shell than the connection end portion of the first connection portion is.

The second connection portion may include a base and a spring. The base may be disposed on the first portion of the outer body. The spring may extend from the base such as to be raised in the second direction and away from the first portion. The spring may be elastically deformable toward the first portion. In the connector of this aspect, the spring of the second connection portion can be brought into elastic contact with a metal casing in the second direction.

A pair of accommodation holes and a pair of ground terminals may be provided. In this case, the first connection portions of the ground terminals may be plates extending along the accommodation hole. The first connection portions may each include a recessed portion having a shape and dimensions conforming to substantially the half of an outline of the shell as viewed in cross-section taken in the second direction, an edge of the recessed portion, the edge being in contact with the shell, a pair of abutments respectively located on opposite sides of the recessed portion. The abutments of one of the ground terminals may be in abutment with the abutments of the other ground terminal in the second direction. In the connector of this aspect, the two halves in the second direction of the shell are fitted in the respective recessed portions of the pair of ground terminals and contacted by the respective edges of the recessed portions, and the abutments of one of ground terminals abut those of the other ground terminal. This arrangement establishes secure connection, and thereby improves reliability of the electrical connection, between the pair of ground terminals and the shell.

Each of the ground terminals may further include an engagement portion at the first connection portion of the ground terminal. The engagement portions of one of the ground terminals may be provided with an engagement projection, and the engagement portion of the other ground terminal may be provided with an engagement hole. The engagement projection may be engaged in the engagement hole. In the connector of this aspect, the engagement projection is engaged with the engagement hole to fix the pair of ground terminals to each other with the shell sandwiched therebetween. This arrangement establishes further secure connection, and thereby further improves reliability of the electrical connection, between the pair of ground terminals and the shell.

A connection structure according to an aspect of the invention includes the connector according to any one of the above aspects and a metal casing. The metal casing may be in contact with the ground terminal according to any of the above aspects.

If the ground terminal includes the second connection portion, the metal casing may be in contact, in the second direction, with the second connection portion of the ground terminal of the connector. In the connecting structure of this aspect, the metal casing can be readily brought into contact and electrical connection, in the second direction, with the second connection portion on the first portion of the outer body.

BRIEF DESCRIPTION OF DRAWINGS

The present invention can be even more fully understood with the reference to the accompanying drawings which are intended to illustrate, not limit, the present invention.

Figure 1A:
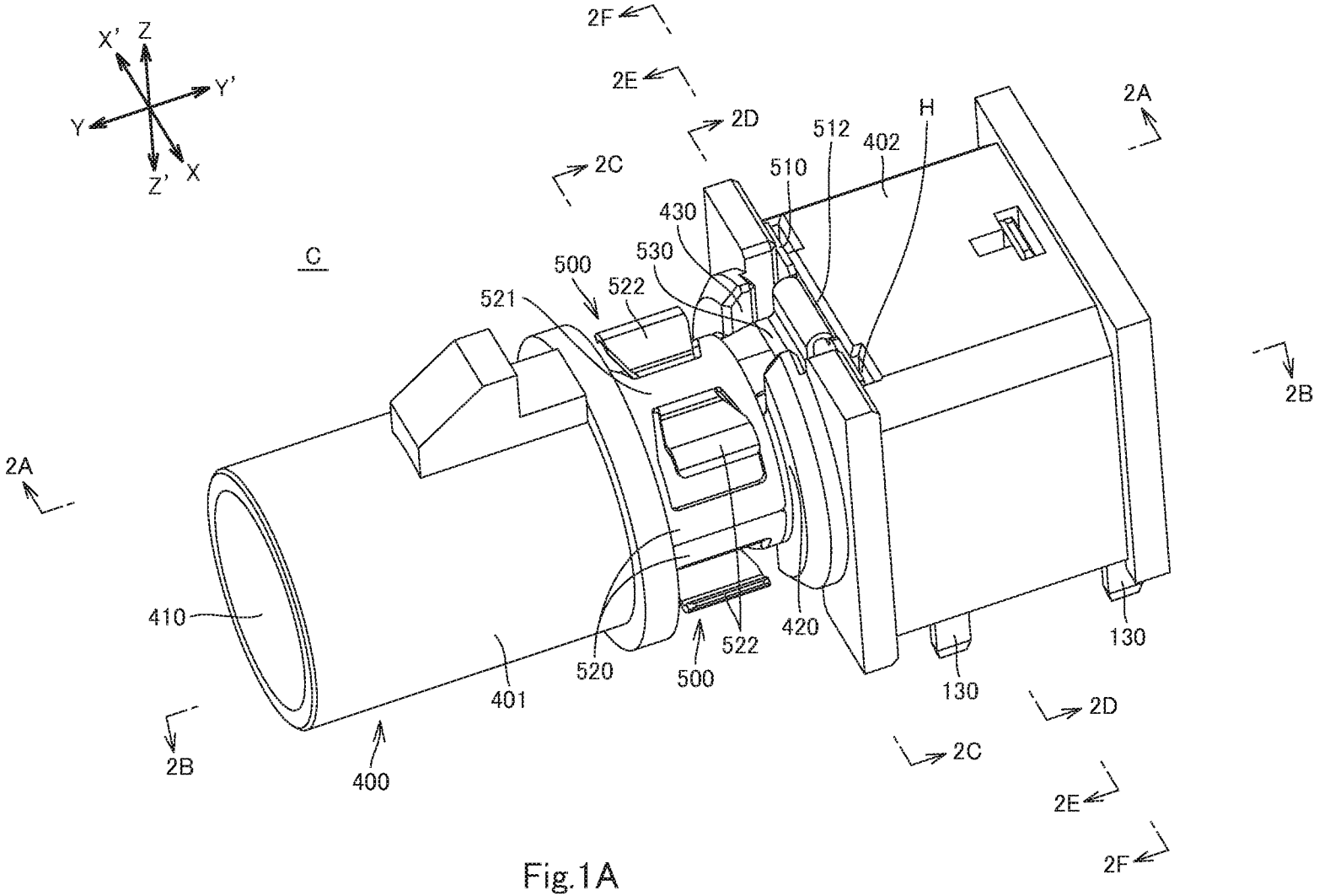
FIG. 1A is a front top right perspective view of a connector according to a first embodiment of the invention.
Figure 1B:
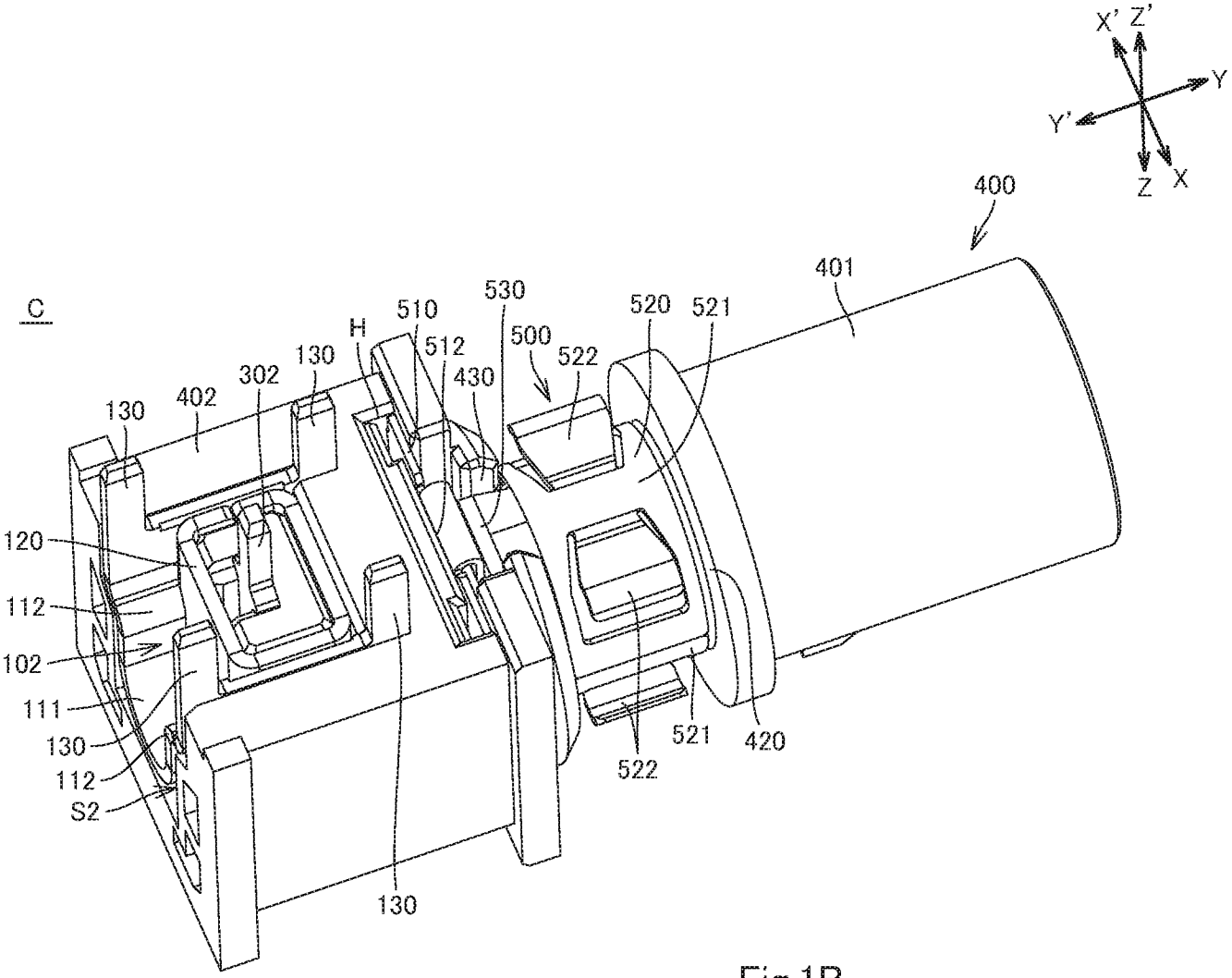
FIG. 1B is a rear bottom right perspective view of the connector.

2D is a sectional view of the connector, taken along a line 2D-2D in FIG. 1A.

Figure 2A:
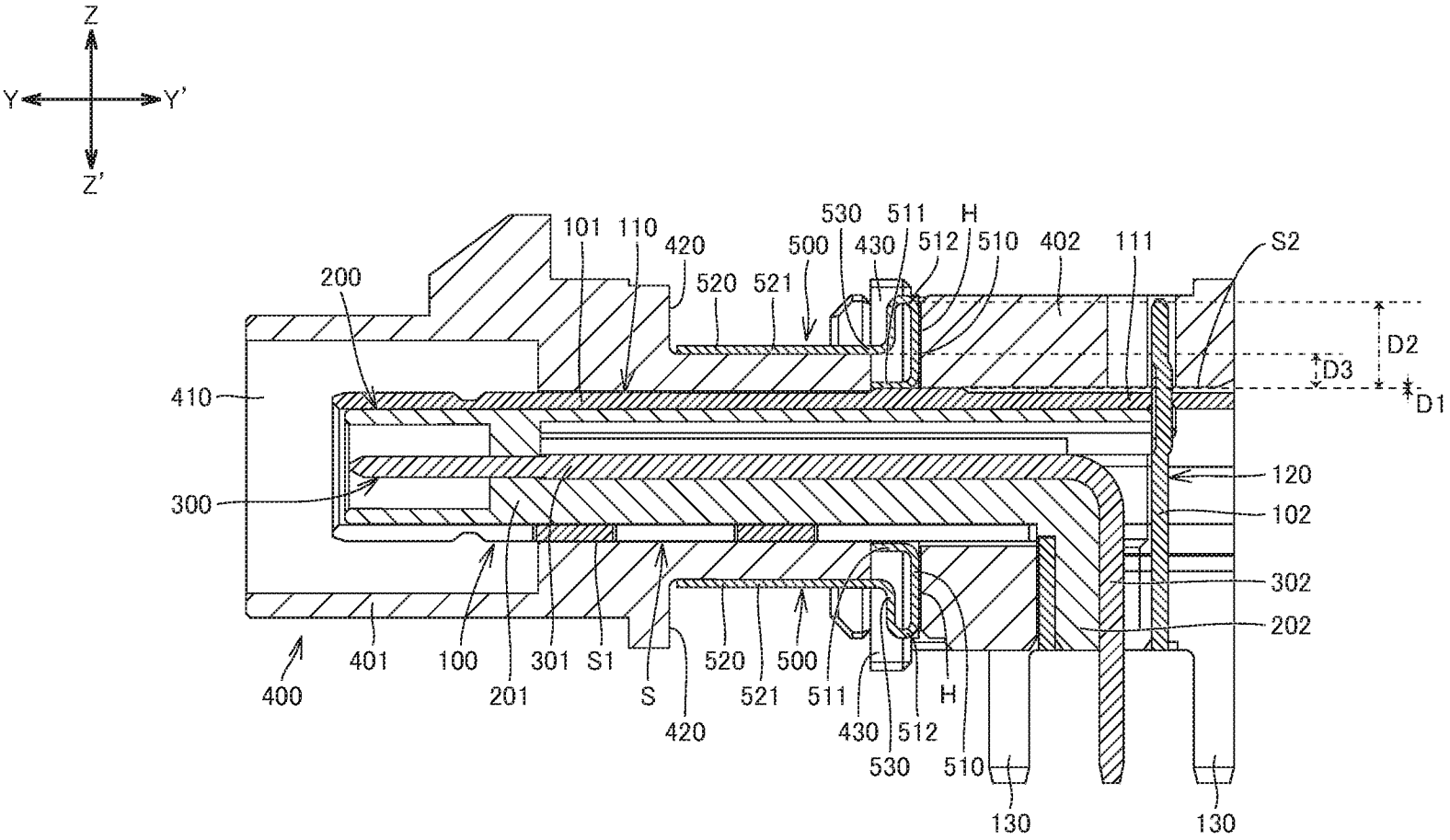
FIG. 2A is a sectional view of the connector, taken along a line 2A-2A in FIG. 1A.
Figure 2B:
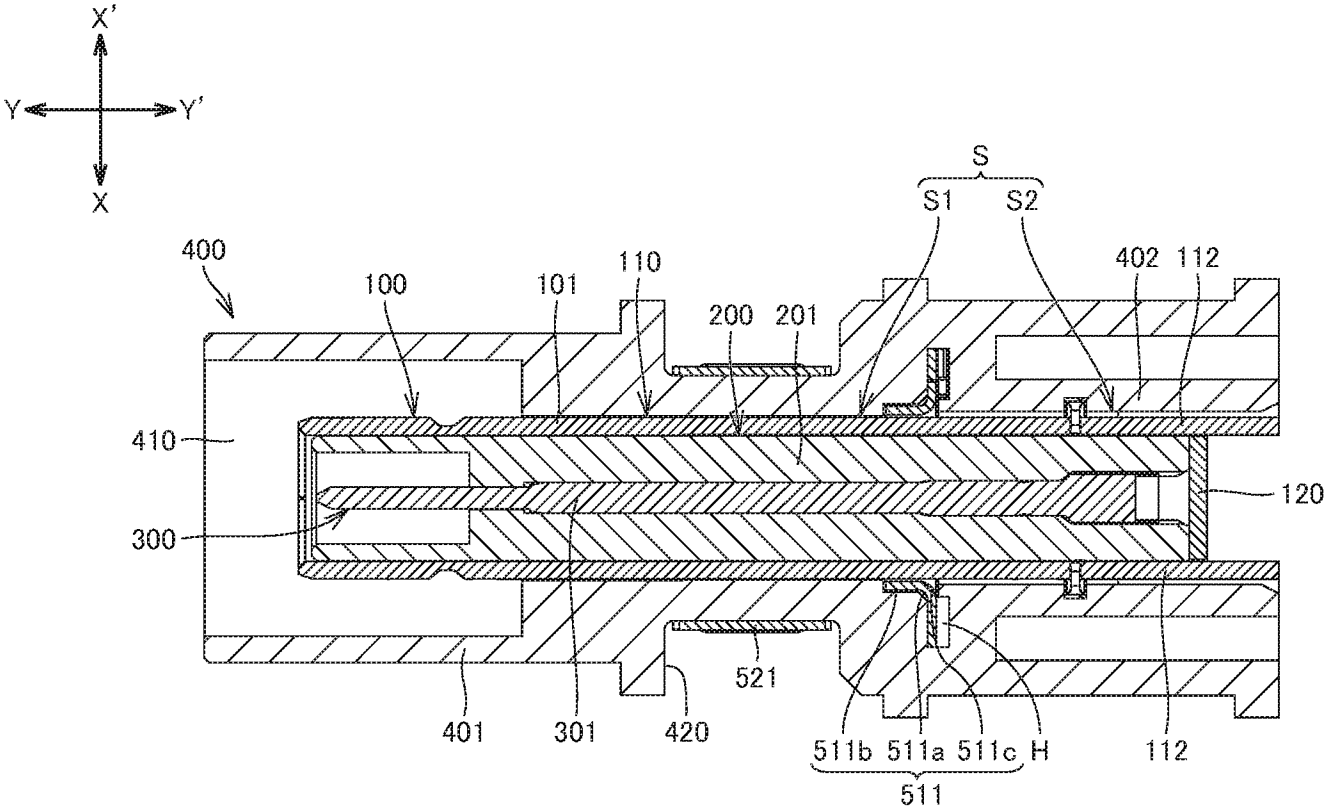
FIG. 2B is a sectional view the connector, taken along a line 2B-2B in FIG. 1A.
Figure 2C:
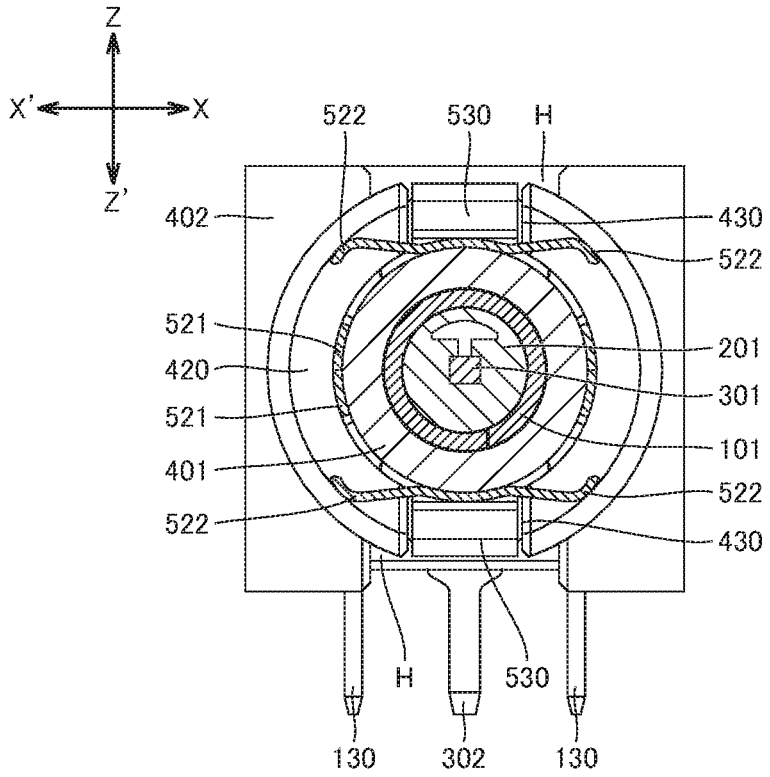
FIG. 2C is a sectional view of the connector, taken along a line 2C-2C in FIG. 1A.
Figure 2D:
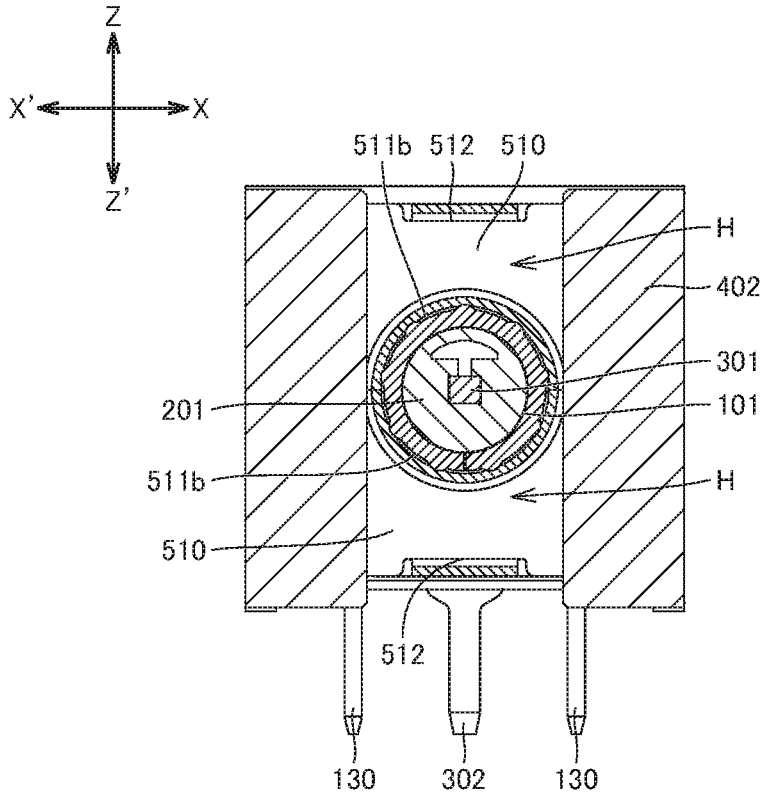
Figure 2E:
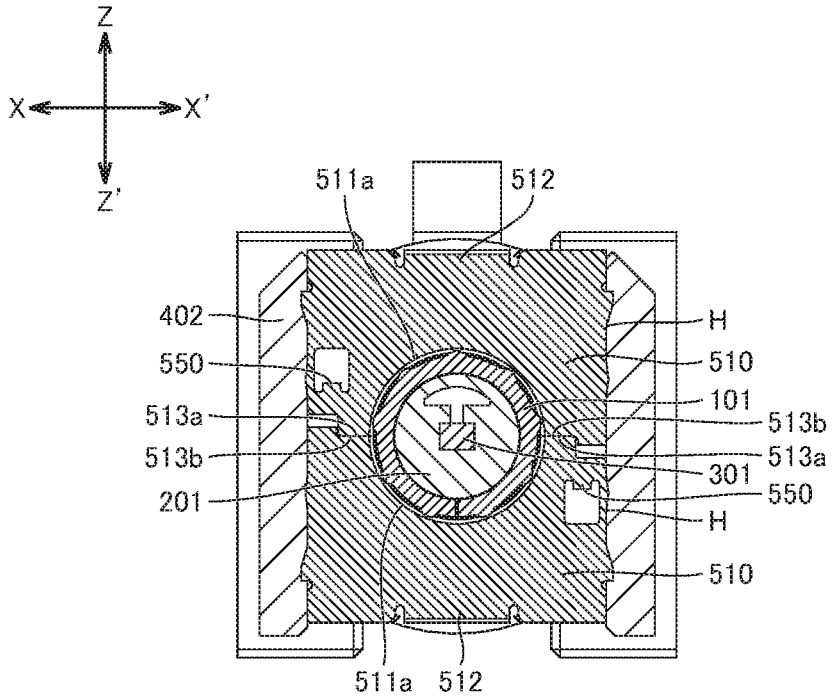

FIG. 2E is a sectional view of the connector, taken along a line 2E-2E in FIG. 1A.

Figure 2F:
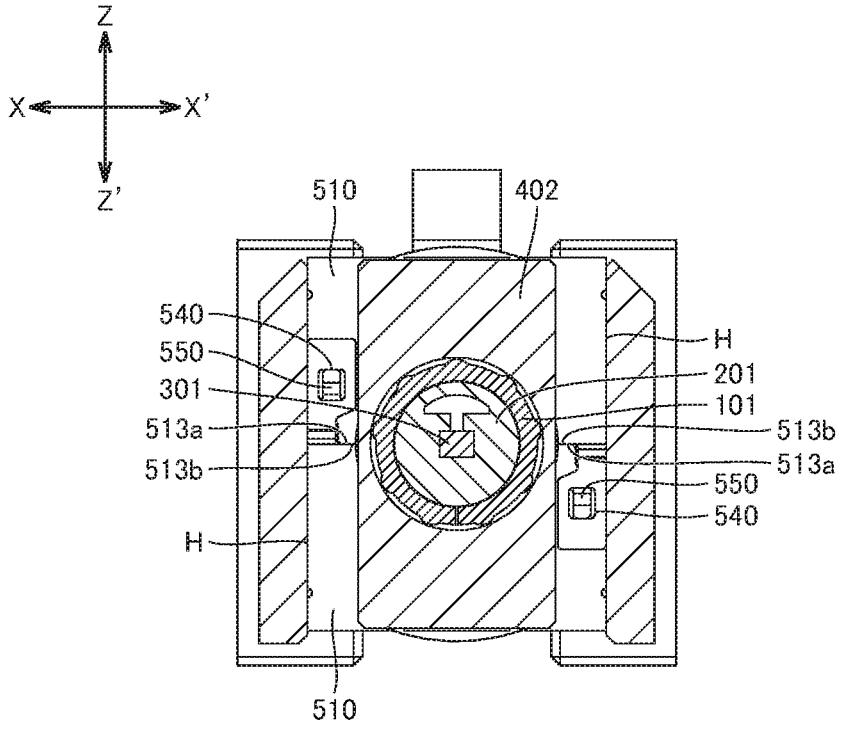

FIG. 2F is a sectional view of the connector, taken along a line 2F-2F in FIG. 1A.

Figure 3A:
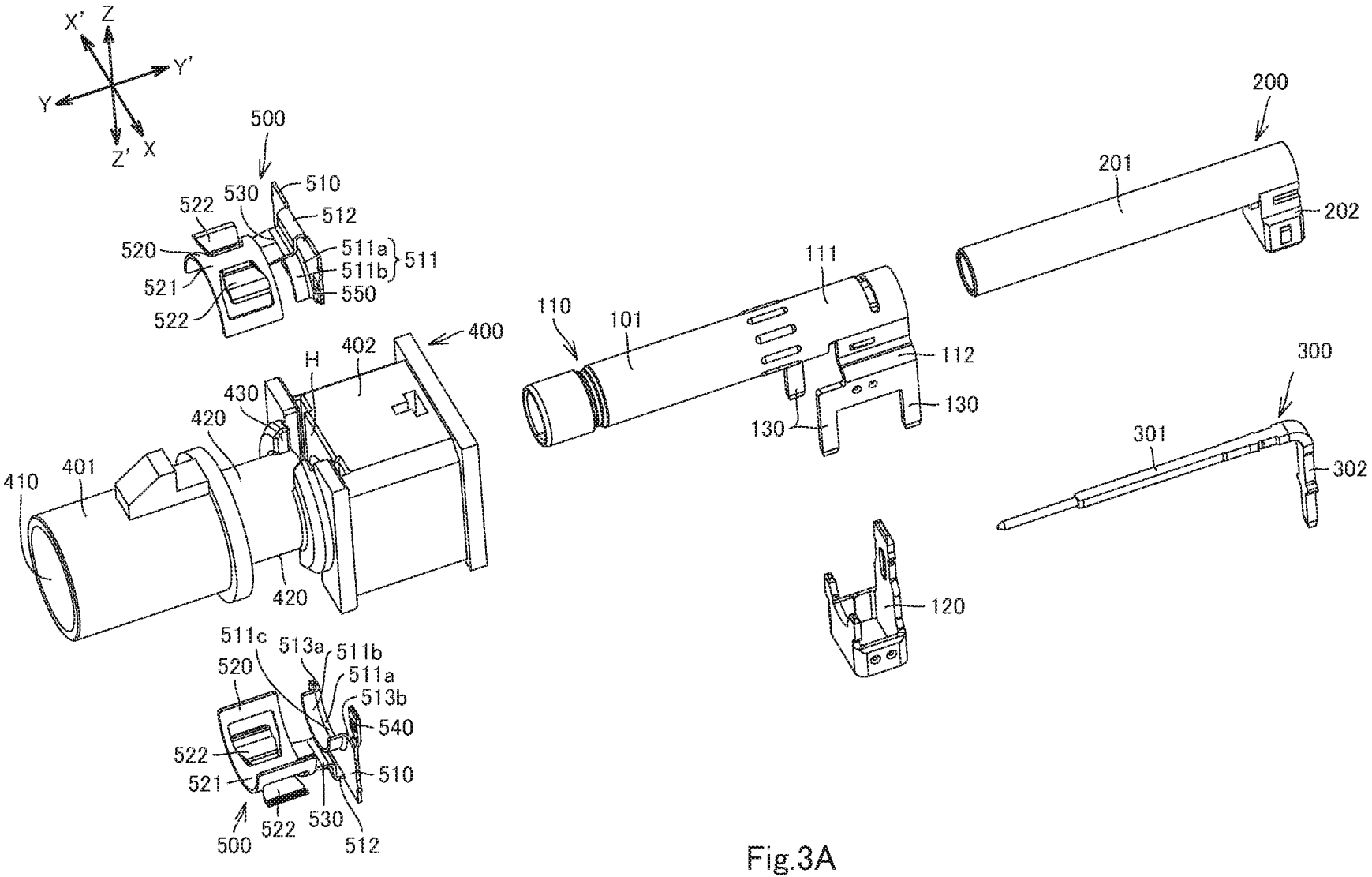

FIG. 3A is a front top right perspective exploded view of the connector.

Figure 3B:
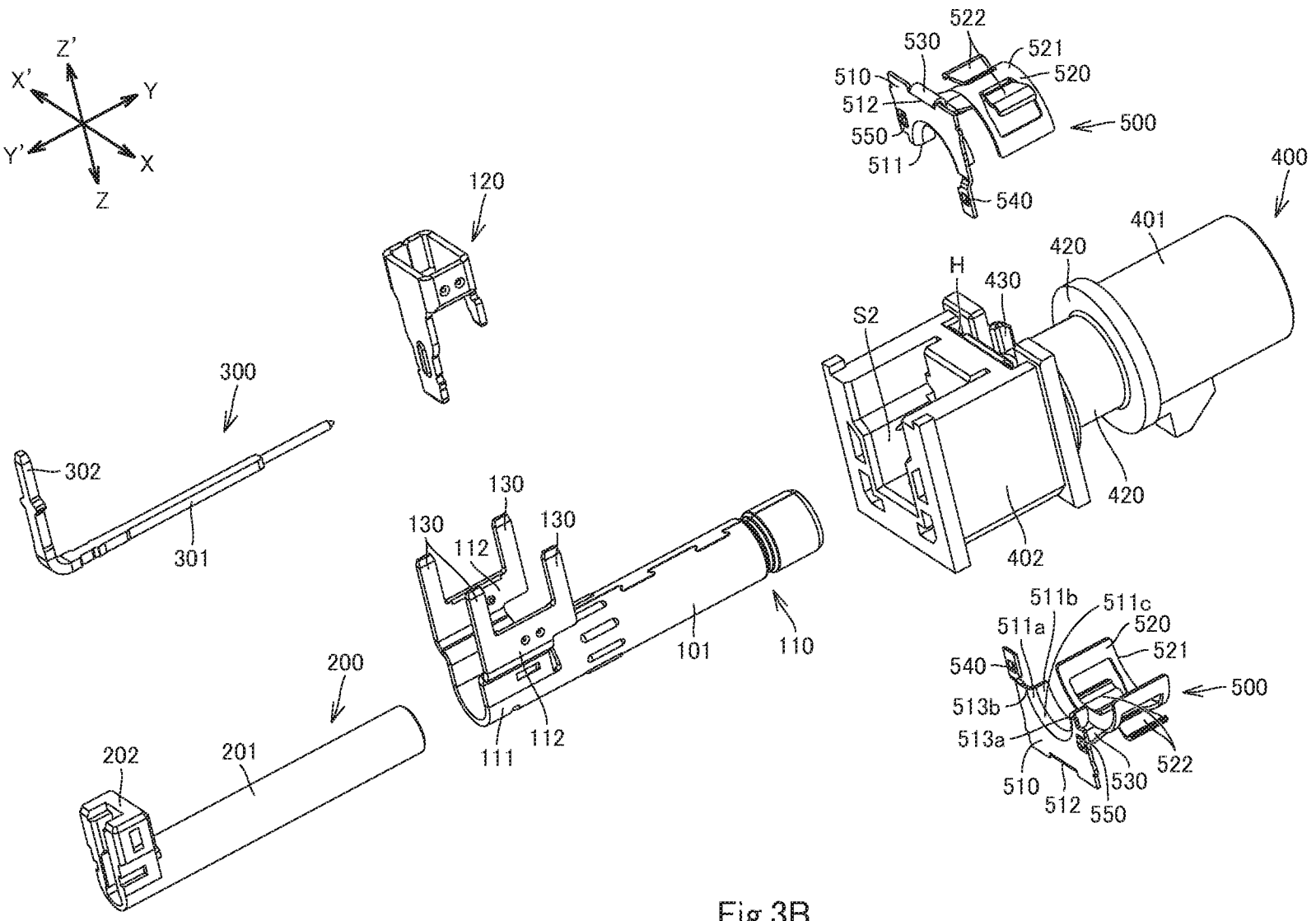

FIG. 3B is a rear bottom right perspective exploded view of the connector.

Figure 4:
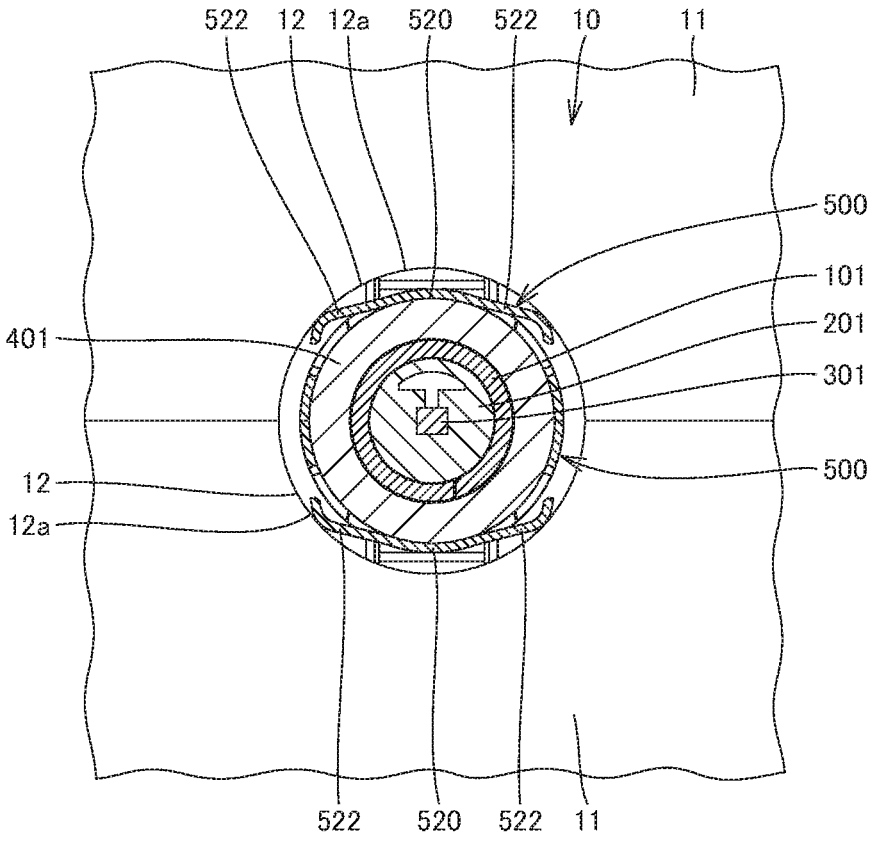

FIG. 4 is a sectional view of the connector and a metal casing, corresponding to FIG. 2C.

DESCRIPTION OF EMBODIMENTS

The following discussion is directed to various embodiments of the invention.

First Embodiment

A connector C according to a plurality of embodiments, including the first embodiment, of the invention will now be described with reference to FIGS. 1A to 3B. FIGS. 1A to 3B illustrate the connector C of the first embodiment. The Y-Y' direction indicated in FIGS. 1A to 2B and FIGS. 3A and 3B corresponds to the first direction in the claims. The Z-Z' direction indicated in FIGS. 1A, 2A, and 2C to 3B corresponds to the second direction in the claims and is orthogonal to the Y-Y' direction. The X-X' direction indicated in FIGS. 1A, 1B, and 2B to 3B corresponds to the third direction in the claims and is orthogonal to the Y-Y' and X-X' directions.

The connector C is a receptacle connector that can be mounted on a circuit board of an electronic device (not shown). The connector C includes a shell 100 having electrical conductivity. For example, the shell 100 may be made of a metal plate (see FIGS. 1A to 3B), which may be pressed into shape. The shell may alternatively be a plastic member with a metal evaporated on an inner or outer surface. The shell 100 includes a first portion 101 and a second portion 102. The first portion 101 has a generally tubular shape, such as a generally circular tubular shape (which may be an elliptic tubular shape) or a generally polygonal tubular shape. The first portion 101 extends in the Y-Y' direction and includes a first end portion on the Y-direction side and a second end portion on the Y'-direction side. The first end portion of the first portion 101 opens in the Y direction. The second portion 102 has a generally tubular shape, such as a generally circular tubular shape (which may be an elliptic tubular shape) or a generally polygonal tubular shape. The second portion 102 communicates with the first portion 101 and extends in the Z-Z' direction, a first oblique direction, or a second oblique direction. The first oblique direction is herein defined as a direction including components of the Z' and Y' directions, and the second oblique direction as a direction including components of the Z' and Y directions. Specifically, the shell 100 may, but is not required to, have one of the following configurations 1) to 3):

Configuration 1): The shell 100 includes a first shell 110 and a second shell 120 as shown in FIGS. 1A to 3B. The first shell 110 includes the above-described first portion 101, a mounting portion 111, and a pair of sidewalls 112. The mounting portion 111 is a plate having a generally U-shape in cross section in the Z-Z' direction and extending in the Y' direction from the second end portion of the first portion 101. The sidewalls 112 extend in the Z' direction, respectively from the X- and X'-direction ends of the mounting portion 111. The second shell 120 extends in the Z-Z' direction and includes a tubular portion disposed between the sidewalls 112. The second shell 120 also includes a first wall on the Y-direction side, which extends in the Z direction from the Y-direction side of the tubular portion, and a second wall on the Y'-direction side, which extends in the Z direction from the Y'-direction side of the tubular portion. The space between the sidewalls 112 is blocked on the Y-direction side by the first wall and blocked on the Y'-direction side by the second wall. The second wall extends through the mounting portion 111. In this configuration, the second portion 102 of the shell 100 is constituted by the pair of sidewalls 112 and the second shell 120.

Configuration 2): The shell 100 includes a first shell 110 and a second shell. The shell 100 of configuration 2) is similar to the shell 100 of configuration 1) but different in that the pair of sidewalls 112 of the first shell 110 is omitted, that the tubular portion of the second shell is larger in Z-Z' direction dimension than the tubular portion of the second shell 120 of the shell 100 of configuration 1), and that the tubular portion of the second shell is fixed to the mounting portion 111. In this configuration, the second portion 102 of the shell 100 is constituted by the second shell.

Configuration 3): The shell 100 includes a first shell 110, but not the above-described second shell 120. In the shell 100 of configuration 3), the first shell 110 is similar to the first shell 110 of configuration 1) but further includes first and second walls. The first wall extends in the Z' direction from the Z'-direction side of the second end portion of the first portion 101, and the second wall extend in the Z' direction from the Y'-direction end of the mounting portion 111. The space between the sidewalls 112 is blocked on the Y-direction side by the first wall and blocked on the Y'-direction side by the second wall. In this configuration, the second portion 102 of the shell 100 is constituted by the pair of sidewalls 112 and the first and second walls.

The shell 100 of any one of the above aspects may further including a plurality of legs 130. The legs 130 may extend from the second portion 102 in the Z' direction (see FIGS. 1A to 3B) or in the Y' direction. Alternatively, one or more of the legs 130 may extend from the second portion 102 in the X direction, and the remaining leg or legs 130 may extend from the second portion 102 in the X' direction. The leg 130 are connectable to the circuit board of the electronic device. The leg 130 may be omitted.

The connector C further includes an inner body 200. The inner body 200 is made of an insulating resin and generally disposed inside the shell 100. The inner body 200 includes a first portion 201 and a second portion 202. The first portion 201 extends in the Y-Y' direction and includes a first end portion on the Y-direction side and a second end portion on the Y'-direction side. The first portion 201 is securely accommodated of the shell 100 of any of the above aspects, particularly in the first portion 101 and an upper part (a part on the Z-direction side) of the second portion 102 of the shell 100. The first end portion of the first portion 201 may be disposed inside the first portion 101 of the shell 100 of any one of the above modes, or alternatively may protrude in the Y direction from the first portion 101. The first end portion of the first portion 201 may have a tubular (see FIGS. 2A and 2B), flat, or block shape. The second portion 202 extends in the Z' direction, the first oblique direction, or the second oblique direction from the second end portion of the first portion 201. The second portion 202 is securely accommodated in a lower part (a part on the Z'-direction side) of the second portion 102 of the shell 100 of any of the above aspects.

The connector C further includes at least one terminal 300 held by the inner body 200 and disposed inside the shell 100. The or each terminal 300 includes a first portion 301 and a second portion 302. More particularly, in the or each terminal 300, the first portion 301 extends in the Y-Y' direction and includes a first end portion on the Y-direction side and a second end portion on the Y'-direction side; the first portion 301 is held in the first portion 201 of the inner body 200 of any of the above aspects; the first end portion of the first portion 301 may be disposed in a tubular first end portion of the first portion 201 of the inner body 200 (see FIGS. 1A to 3B), may project in the Y direction from a flat or block-shaped first end portion of the first portion 201, or may be exposed from the Z- or Z'-direction-side face of a flat or block-shaped first end portion of the first portion 201; the second portion 302 extends from the second end portion of the first portion 301 in the Z' direction, the first oblique direction, or the second oblique direction to be held in the combination of the second end portion of the first portion 201 and the second portion 202 of the inner body 200 of any of the above aspects; the end portion on Z'-direction side of the second portion 302 protrudes in the Z' or Y' direction from the second portion 202 of the inner body 200; and this end portion may be connectable to the circuit board of the electronic device.

If a plurality of terminals 300 is provided, they are held by the inner body 200 and arranged at spaced intervals. For example, the terminals 300 may be held by the inner body 200 in such an arrangement in front view (i.e. as viewed from the Y-direction side) that the first portions 301 are arranged at spaced intervals in a row along the X-X' direction, or that the first portions 301 are arranged in a plurality of rows in the Z-Z' direction, in each of which rows the first portions 301 are arranged at spaced intervals along the X-X' direction.

The connector C further includes an outer body 400 made of an insulating resin. The outer body 400 includes a first portion 401 and a second portion 402. The first portion 401 and the second portion 402 defines an accommodation space S for securely accommodating the shell 100. The first portion 401 extends in the Y-Y' direction and has a generally tubular shape, such as a generally circular tubular shape (which may be an elliptic tubular shape) or a generally polygonal tubular shape. More specifically, the first portion 401 may, but is not required to, extend in the Y direction from the second portion 402 (see FIGS. 1A to 3B). The outer body 400 may further include an intermediate portion between the first portion 401 and the second portion 402, in which case the first portion 401 may extend in the Y direction from the intermediate portion. The second portion 402, which is a rectangular or columnar block, can be placed on the circuit board of the electronic device. The second portion 402 has at least one of the following configurations a) and b).

Configuration a): The second portion 402 (see FIGS. 2D to 2F) has outer dimensions, as viewed in the Z-Z' direction cross-section, that are larger than those of the first portion 401 (see FIG. 2C). More specifically, the second portion 402 may have, but not limited to, the following configuration a-1) and/or a-2).

Configuration a-1): The second portion 402 has a rectangular block shape, while the first portion 401 has a generally circular tubular shape (which may be an elliptic tubular shape). In this case, the second portion 402 may have a dimension in the Z-Z' direction equal to that of the first portion 401, and have a dimension in the X-X' direction equal to that of the first portion 401. The second portion 402 may further have configuration a-2) below.

Configuration a-2): The second portion 402 is larger than the first portion 401 in dimension in the Z-Z' direction and/or in dimension in the X-X' direction.

Configuration b): The second portion 402 is larger than the first portion 401 in wall thickness in the Z-Z' direction. The wall thickness of the second portion 402 is the wall thickness in the Z-Z' direction from the wall of the accommodation space S of the second portion 402 to an outer face of the second portion 402. The wall thickness of the first portion 401 is the wall thickness in the Z-Z' direction from the wall of the accommodation space S of the first portion 401 to the associated outer face of the first portion 401 (see FIG. 2A). The wall of the accommodation space S abuts the first portion 101 of the shell 100.

The accommodation space S includes a first accommodation space S1 and a second accommodation space S2. The first accommodation space S1 is provided in the first portion 401 and extends in the Y-Y' direction. The first accommodation space S1 has a shape and size corresponds to the outer cross-sectional dimensions of the first portion 101 of the shell 100. The first accommodation space S1 securely accommodates the first portion 101 of the shell 100 partly. The second accommodation space S2 is provided in the second portion 402 and communicates with the first accommodation space S1. The second accommodation space S2 accommodates the second portion 102 of the shell 100, and a portion of the first portion 101 of the shell 100, which portion is located on the Y'-direction side relative to the portion of the first portion 101 accommodated in the first accommodation space S1.

The first portion 401 of the outer body 400 is provided at its Y-direction side with an opening 410, which communicates with the first accommodation space S1 and opens in the Y direction. The opening 410 may preferably accommodate the first end portion of the first portion 101 of the shell 100 of any of the above aspects, the first end portion of the first portion 201 of the inner body 200, and the first end portion of the first portion 301 of the or each terminal 300. Alternatively, if the first end portion of the first portion 201 of the inner body 200 of any of the above aspects protrudes in the Y direction from the first end portion of the first portion 101 of the shell 100, the opening 410 may accommodate the first end portion of the first portion 201 of the inner body 200 and the first end portion of the first portion 301 of the or each terminal 300. Still alternatively, if the first end portion of the first portion 301 of the or each terminal 300 of any of the above aspects protrudes in the Y direction from the first end portion of the first portion 201 of the inner body 200, the opening 410 may accommodate the first end portion of the first portion 301 of the or each terminal 300. In either case, the first end portion of the first portion 301 of the or each terminal 300 in the opening 410 is the portion that is contactable with a corresponding terminal of a mating connector (not shown).

At least one accommodation hole H is provided in the second portion 402 of the outer body 400, particularly in a portion of the second portion 402 that have the outer dimensions as described for configuration a) above and/or in a portion (thick portion) that has the wall thickness as described for configuration b) above. The at least one accommodation hole H opens to the outer face of the second portion 402 of the outer body 400, extending from this outer face to the second accommodation space S2 of the accommodation space S. The at least one accommodation hole H may extend in the Z-Z' direction or an oblique direction including components of the Z-Z' and Y-Y' directions, but it is not limited thereto. The first portion 101 of the shell 100 is partly exposed through the at least one accommodation hole H to the outside of the second portion 402 of the outer body 400. This exposed portion will be referred to as an exposed portion of the shell 100.

The connector C further includes at least one ground terminal 500 formed of a metal plate, e.g. formed by pressing a metal plate. The at least one ground terminal 500 is only required to be disposed in the corresponding accommodation hole H of the outer body 400, and be in contact with the exposed portion of the shell 100, and be partly exposed from the outer body 400 or partly disposed outside of the outer body 400. The or each ground terminal 500 may include a first connection portion 510, a second connection portion 520, and a junction 530 as specified below.

The first connection portion 510 is a plate extending along the accommodation hole H of the outer body 400 such as to be securely accommodated in the corresponding accommodation hole H and in contact with the exposed portion of the shell 100. The first connection portion 510 includes a contact portion 511 and a connection end portion 512. The contact portion 511 may have any configuration as long as it is provided at the inner end portion of the first connection portion 510 and is in contact with the exposed portion of the shell 100 inside the accommodation hole H. For example, if the first connection portion 510 includes a recessed portion 511*c*, which is recessed conforming to the shape of a part of the exposed portion of the shell 100, and an edge 511*a* of the recessed portion 511*c*, it may be the contact portion 511 that includes the edge 511*a* of the recessed portion 511*c*. The part of the exposed portion of the shell 100 is fitted in the recessed portion 511*c* and is in contact with the edge 511*a*. The contact portion 511 may further include a flange 511*b* (see FIGS. 2A, 2B, 3A, and 3B), which extends in the Y-Y' direction from the edge 511*a* of the recessed portion 511*c* and is in contact with the exposed portion of the shell 100. The flange 511*b* is also in contact with the part of the exposed portion of the shell 100. The contact area between the contact portion 511 and the exposed portion of the shell 100 is enlarged because the flange 511*b*, in addition to the edge 511*a*, is brought into contact with the part of the exposed portion of the shell 100. The connection end portion 512 is an outer end portion of the first connection portion 510 and is contiguous with one end of the junction 530. The connection end portion 512 is exposed through, or projects from, the accommodation hole H. In the Z-Z' direction, the connection end portion 512 is located farther from the first portion 101 of the shell 100 than the contact portion 511. It should be noted that the inner end portion of the first connection portion 510 is located toward the bottom of the accommodation hole H, and the outer end portion of the first connection portion 510 is located toward or outside the entrance of the accommodation hole H. The flange 511*b* may be omitted.

The second connection portion 520 includes a base 521, which is a plate disposed on the first portion 401 of the outer body 400. The base 521 may preferably, but is not limited to, have a shape conforming to the outer shape of a part in the Y-Y' direction (supporting part) of the first portion 401 of the outer body 400 (for example, an arc shape, a semicircular shape, a generally U-shape, or a generally square U-shape in cross-section in the Z-Z' direction conforming to the outer shape of the supporting part of the first portion 401 of the outer body 400). Alternatively, the base 521 may be a flat plate. The base 521 includes a connection end portion. The connection end portion of the base 521 is an end portion on the Y'-direction side of the base 521 and is coupled to the other end of the junction 530.

The second connection portion 520 may further include at least one spring 522. The at least one spring 522 may be raised in the Z-Z' direction from the base 521 away from the first portion 401 of the outer body 400. The or each spring 522 may be formed by cutting and raising a part of the base 521 of any of the above aspects, or may be provided at an end of the base 521. If a pair of springs 522 is provided, they may or may not be symmetrically shaped in the X-X' direction, or they may have different shapes. For example, the springs 522 may have different lengths in order to improve vibration resistance. Three or more springs 522 may be provided, or the spring 522 may be omitted.

The junction 530 is a flat or curved plate extending from the connection end portion 512 of the first connection portion 510 to the connection end portion of the second connection portion 520.

In any cross-section in the Y-Y' direction of the connector C (for example, FIG. 2A illustrates a cross-section of the connector C through the center axis of the first portion 101 of the shell 100), distance relationship D1<D2 is satisfied, and distance relationship D3<D2 may or may not be satisfied, where D1 is a distance in the Z-Z' direction between the contact portion 511 of the first connection portion 510 of the or each ground terminal 500 and the first portion 101 of the shell 100, D2 is a distance in the Z-Z' direction between the connection end portion 512 of the first connection portion 510 and the first portion 101 of the shell 100, and D3 is a distance in the Z-Z' direction between the base 521 of the second connection portion 520 and the first portion 101 of the shell 100.

The distance D1 is invariably zero because the contact portion 511 of the first connection portion 510 of the or each ground terminal 500 of aspect described above is in contact with the exposed portion of the shell 100. Also, relation D1<D2 is satisfied because the connection end portion 512 of the first connection portion 510 is located farther in the Z-Z' direction from the shell 100 than the contact portion 511 is.

In connection with the distance relationship between D2 and D3, the base 521 of the second connection portion 520 of the or each ground terminal 500 is located at one of the height positions 1) to 3) in the Z-Z' direction.

1) The base 521 is located at a height position in the Z-Z' direction that is farther from the shell 100 than the contact portion 511 of the first connection portion 510 and nearer to the shell 100 than the connection end portion 512 of the first connection portion 510 (see FIG. 2A). In this case, there is a distance relationship D3<D2. In order to satisfy D3<D2, the first portion 401 of the outer body 400 may be, but is not required to be, provided with at least one accommodation recess 420, which or each of which accommodates the corresponding base 521. That is, D3<D2 can be satisfied without any accommodation recesses 420.

Optionally, the second portion 402 of the outer body 400 may be provided with a passage 430 to connect between the or each accommodation recess 420 and the corresponding accommodation hole H and accommodate the corresponding junction 530 as shown in FIGS. 1A to 3B.

2) The base 521 is located at the same height position in the Z-Z' direction as the connection end portion 512 of the first connection portion 510. In this case, there is a distance relationship D3=D2. In order to satisfy D3=D2, the first portion 401 of the outer body 400 may have a dimension in the Z-Z' direction substantially equal to that of the second portion 402 of the outer body 400, or alternatively the or each first connection portion 510 may have such a dimension in the Z-Z' direction that the connection end portion 512 is located at the same height position in the Z-Z' direction as the base 521.

3) The base 521 is located at a height position in the Z-Z' direction that is farther from the shell 100 than the connection end portion 512 of the first connection portion 510. In this case, there is a distance relationship D3>D2. In order to satisfy D3>D2, the first connection portion 510 may preferably have such a dimension in the Z-Z' direction that the connection end portion 512 is located at the height position that is farther from the first portion 101 of the shell 100 than the base 521.

If a pair of the ground terminals 500 of any of the above aspects is provided and the outer body 400 is provided with a pair of the accommodation holes H of any of the above aspects, the ground terminals 500 and the accommodation holes H may be configured as follows.

The pair of accommodation holes H may, but is not required to, be located on opposite sides of the exposed portion of the shell 100 and communicate with each other to form a ring-shaped hole. Such ring-shaped annular hole may open in the outer faces on the Z- and Z'-direction side of the outer body 400.

The pair of ground terminals 500 may be hereinafter referred to as a first ground terminal 500 and a second ground terminal 500. In each of the first and second ground terminals 500, the first connection portions 510 includes the recessed portion 511*c*, and the edge 511*a* of the recessed portion 511*c*, and the flange 511*b* as described above.

The recessed portion 511*c* of the first ground terminal 500 has a shape and dimensions conforming to substantially the half on the Z direction side of the outline of the exposed portion of the shell 100 as viewed in cross-section taken in the Z-Z' direction. Likewise, the edge 511*a* of the recessed portion 511*c* and the flange 511*b* (the contact portion 511) of the first ground terminal 500 each have a shape and dimensions conforming to the same half of the outline of the exposed portion of the shell 100. The substantially the half on the Z direction side of the exposed portion of the shell 100 is fitted in the recessed portion 511*c* of the first ground terminal 500 and in contact with the edge 511*a* of the recessed portion 511*c* and the flange 511*b* of the first ground terminal 500.

The recessed portion 511*c* of the second ground terminal 500 has a shape and dimensions conforming to substantially the half on the Z' direction side of the outline of the exposed portion of the shell 100 as viewed in cross-section taken in the Z-Z' direction. Likewise, the edge 511*a* of the recessed portion 511*c* and the flange 511*b* (the contact portion 511) of the second ground terminal 500 also have a shape and dimensions conforming to the same half of the outline of the exposed portion of the shell 100. The substantially the half on the Z' direction side of the exposed portion of the shell 100 is fitted in the recessed portion 511*c* of the second ground terminal 500 and in contact with the edge 511*a* of the recessed portion 511*c* and the flange 511*b* of the second ground terminal 500. The flanges 511*b* of the first and second ground terminals 500 may be omitted.

The first connection portion 510 of the first ground terminal 500 further includes abutments 513*a*, 513*b* on respective opposite sides of the edge 511*a* of the recessed portion 511*c* of the contact portion 511 of the first ground terminal 500. Likewise, the first connection portion 510 of the second ground terminal 500 further includes abutments 513*a*, 513*b* on respective opposite sides of the edge 511*a* of the recessed portion 511*c* of the contact portion 511 of the second ground terminal 500. In an embodiment in which the two accommodation holes H form the ring-shaped hole as described above, the abutment 513*a* of the first ground terminal 500 and the abutment 513*b* of the second ground terminal 500 abut each other in the Z-Z' direction inside the ring-shaped hole, and the abutment 513*a* of the second ground terminal 500 and the abutment 513*b* of the first ground terminal 500 also abut each other in the Z-Z' direction inside the ring-shaped hole (see FIGS. 2E and 2F). These abutments establish electrical connection between the first and second ground terminals 500.

The first and second ground terminals 500 may each further include an engagement portion 540 and an engagement portion 550. The engagement portion 540 of the first ground terminal 500 extends from the vicinity of the abutment 513*b* of the first connection portion 510 of the first ground terminal 500 to, and is in abutment with, the first connection portion 510 of the second ground terminal 500. The engagement portion 540 of the second ground terminal 500 extends from the vicinity of the abutment 513*b* of the first connection portion 510 of the second ground terminal 500 to, and is in abutment with, the first connection portion 510 of the first ground terminal 500. The portion of the first connection portion 510 of the second ground terminal 500 that abuts the engagement portion 540 of the first ground terminal 500 will be hereinafter referred to as an abuttable portion of the first connection portion 510 of the second ground terminal 500, and the portion of the first connection portion 510 of the first ground terminal 500 that abuts the engagement portion 540 of the second ground terminal 500 will be referred to as an abuttable portion of the first connection portion 510 of the first ground terminal 500. The engagement portion 550 of the first ground terminal 500 is provided at the abuttable portion of the first connection portion 510 of the first ground terminal 500. The engagement portion 550 of the second ground terminal 500 is provided at the abuttable portion of the first connection portion 510 of the second ground terminal 500. In each terminal 500, one of the engagement portion 540 and the engagement portion 550 is provided with an engagement projection, the other is provided with an engagement hole, and the engagement projection is engaged with the engagement hole. Specifically, the engagement projection is in contact with an edge of the engagement hole. The first and second ground terminals 500 are mechanically connected to each other by bringing their engagement projections into engagement with the mating engagement holes.

The base 521 of the second connection portion 520 of the first ground terminal 500 may have a shape (e.g., generally a semicircular, U-shaped, or square U-shaped cross-sectional shape) conforming to the outer shape of substantially the half on the Z direction side of the supporting part of the first portion 401 of the outer body 400. Likewise, the base 521 of the second connection portion 520 of the second ground terminal 500 may have a shape (e.g., generally a semicircular, U-shaped, or square U-shaped cross-sectional shape) conforming to the outer shape of substantially the half on the Z' direction side of the supporting part of the first portion 401 of the outer body 400.

If a pair of the ground terminals 500 and a pair of the accommodation holes H are provided, if the outer body 400 may accordingly include a pair of the accommodation recesses 420 and a pair of the passages 430. In this case, the accommodation recesses 420 may also, in a similar manner to the accommodation holes H, communicate with each other on opposite sides of the first portion 401 of the outer body 400 to form a ring-shaped accommodation recess. Inside such ring-shaped accommodation recess, the X-direction end (first end) of the base 521 of the first ground terminal 500 abuts the X-direction end (first end) of the base 521 of the second ground terminal 500, and the X'-direction end (second end) of the base 521 of the first ground terminal 500 abuts the X'-direction end (second end) of the base 521 of the second ground terminal 500. If no accommodation recesses 420 are provided, it may preferably on the supporting part of the first portion 401 of the outer body 400 that the X-direction end of the base 521 of the first ground terminal 500 abuts the X-direction end of the base 521 of the second ground terminal 500, and that the X'-direction end of the base 521 of the first ground terminal 500 abuts the X'-direction end of the base 521 of the second ground terminal 500. In any of the above cases, the second connection portions 520 of the first and second ground terminals 500 are electrically connected to each other. In an embodiment, the X-direction end of the base 521 of the first ground terminal 500 do not abut the X-direction end of the base 521 of the second ground terminal 500, and the X'-direction end of the base 521 of the first ground terminal 500 do not abut the X'-direction end of the base 521 of the second ground terminal 500.

The or each ground terminal 500 may be constituted only by the first connection portion 510. In this case, the connection end portion 512 of the or each first connection portion 510 may preferably be exposed through, or project from, the corresponding accommodation hole H.

The at least one ground terminal 500 of the connector C of any of the above aspects is connectable to a metal casing 10 (frame ground) of the electronic device. A connection structure of the connector C and the metal casing 10 will now be described in detail with reference to FIG. 4. FIG. 4 illustrates the connector C of the first embodiment and the metal casing 10 connected to the connector C.

The metal casing 10 accommodates the circuit board of the electronic device and the connector C mounted on the circuit board. The metal casing 10 includes at least one metal plate 11, which is connected to the at least one ground terminal 500 of any of the above aspects, specifically in one of the following manners 1) to 3).

Connection configuration 1): In the case where the or each ground terminal 500 includes the first connection portion 510, the second connection portion 520, and the junction 530, and where the or each second connection portion 520 has the at least one spring 522, it is the at least one spring 522 that is in contact with the corresponding metal plate 11 in the Z-Z' direction. In this case, the at least one spring 522 is in elastic contact with the metal plate 11 and elastically deformed toward the base 521. This generates spring pressure (predetermined contact pressure) of the at least one spring 522, so that the second connection portion 520 of the or each ground terminal 500 is electrically connected to the corresponding metal plate 11.

Connection configuration 2): In the case where the or each ground terminal 500 includes the first connection portion 510, the second connection portion 520, and the junction 530, but where the or each second connection portion 520 does not have any springs 522, it is the base 521 of the second connection portion 520 that is in contact with the corresponding metal plate 11 in the Z-Z' direction. This establishes electrical connection between the second connection portion 520 of the or each ground terminal 500 and the corresponding metal plate 11.

Connection configuration 3): In the case where the or each ground terminal 500 is constituted only by the first connection portion 510, it is the connection end portion 512 of the first connection portion 510 that is in contact with the corresponding metal plate 11 in the Z-Z' direction. This establishes electrical connection between the first connection portion 510 of the or each ground terminal 500 and the corresponding metal plate 11.

The or each metal plate 11 may include a recess 12 and an edge 12*a* of the recess 12. The edge 12*a* of the or each metal plate 11 is electrically connected to the corresponding ground terminal 500 in any of the following manners 1-1) to 1-3).

Connection configuration 1-1): The recess 12 of the or each metal plate 11 receives therein, in the Z-Z' direction, the supporting part of the first portion 401 of the outer body 400 and the second connection portion 520 of the corresponding ground terminal 500 of the connector C. Similarly, to connection configuration 1) above, it is the at least one spring 522 of the second connection portion 520 of the or each ground terminal 500 that is in contact with the edge 12*a* of the recess 12 of the corresponding metal plate 11.

Connection configuration 1-2): The recess 12 of the or each metal plate 11 receives therein, in the Z-Z' direction, the supporting part of the first portion 401 of the outer body 400 and the second connection portion 520 of the corresponding ground terminal 500 of the connector C. Similarly, to connection configuration 2) above, it is the base 521 of the second connection portion 520 of the or each ground terminal 500 that is in contact with the edge 12*a* of the recess 12 of the corresponding metal plate 11.

Connection configuration 1-3): The recess 12 of the or each metal plate 11 receives therein, in the Z-Z' direction, the outer body 400 and the first connection portion 510 of the corresponding ground terminal 500 of the connector C. Similarly, to connection configuration 3) above, it is the connection end portion 512 of the first connection portion 510 of the or each ground terminal 500 that is in contact with the edge 12*a* of the recess 12 of the corresponding metal plate 11.

The metal casing 10 may include two metal plates 11. As shown in FIG. 4, each metal plate 11 may have the above-described recess 12 and edge 12*a*. In this case, the recess 12 of one of the metal plates 11 receives therein, from the Z' direction side, a part on Z-direction side of the supporting part of the first portion 401 of the outer body 400 and the second connection portion 520 of the first ground terminal 500. Likewise, the recess 12 of the other metal plate 11 receives therein, from the Z direction side, a part on Z'-direction side of the supporting part of the first portion 401 of the outer body 400 and the second connection portion 520 of the second ground terminal 500. The edges 12*a* of the recesses 12 of the two metal plates 11 are electrically connected to the second connection portions 520 of the first and second ground terminals 500 in a manner as described for connection configuration 1-1) or 1-2) above.

If two metal plates 11 are provided, only one of them may include the recess 12 and the edge 12*a*, and the other may include a closing end (not shown) to close the recess 12. In this case, the edge 12*a* of the recess 12 of the one metal plate 11 is electrically connected to the second connection portion 520 of the first ground terminal 500 in a manner as described for connection configuration 1-1) or 1-2) above. The closing end of the other metal plate 11 abuts the one metal plate 11 in the Z-Z' direction so as to close the recess 12 of the one metal plate 11. The closing end of the other metal plate 11 may be in contact with at least one spring 522 of the second connection portion 520 of the second ground terminal 500 in a similar manner to connection configuration 1) above, or may be in contact with the base 521 of the second connection portion 520 of the second ground terminal 500 in a similar manner to connection configuration 2) above.

The at least one metal plate 11 is not required to be in contact with the at least one ground terminal 500 in the Z-Z' direction, but may alternatively be in contact with the at least one ground terminal 500 in a direction other than the Z-Z' direction (for example, in a direction including a component of a direction orthogonal to the Y-Y' direction).

The connector C described above provides the following technical features and effects.

1) The connector C is configured such that the shell 100 inside the outer body 400 has improved grounding while retaining sufficient strength of the first portion 401 of the outer body 400, compared with a receptacle connector of a comparison example having the following configuration. The receptacle connector of the comparison example has an outer body in which the first portion has a tubular shape extending in the Y-Y' direction from the second portion or from an intermediate portion between the first and second portions, and the first portion of the outer body has outer dimensions smaller than those of the second portion of the outer body and/or has a wall thickness in the Z-Z' direction that is smaller than that of the second portion of the outer body. In the receptacle connector of the comparison example, it is difficult to provide the first portion of the outer body with such sufficient strength as to have an accommodation hole. Sufficient strength may be provided by increasing the outer dimensions and/or the wall thickness of the first portion, but such connector is disadvantageously enlarged. In contrast, in the connector C, the second portion 402 of the outer body 400 is configured as described as Configuration a) and/or b) above and provided with the at least one accommodation hole H for accommodating the at least one ground terminal 500. The at least one ground terminal 500 has a portion that is exposed through, or projects from, the at least one accommodation hole H in the outer body 400, and this exposed or projected portion is brought into contact with the metal casing 10. This arrangement contributes to improved grounding of the shell 100 inside the outer body 400 while retaining sufficient strength of the first portion 401. Therefore, the connector C exhibits desired electromagnetic compatibility (EMC) characteristics. Further, the first portion 401 has no accommodation holes. Such first portion 401 is minimized by the space for the accommodation holes, and accordingly the connector C is minimized.

2) If the or each ground terminal 500 includes the second connection portion 520, it is easy to bring the metal casing 10 into physical contact in the Z-Z' direction with, and thereby into electrical connection with, the second connection portion 520. Further, the second connection portion 520 of the or each ground terminal 500 is simply disposed on the supporting part of the first portion 401 of the outer body 400. This is particularly advantageous in the case where the metal casing 10 includes one or more metal plates 11 of a larger wall thickness in the Y-Y' direction. Such metal plate or plates 11 can also be brought into contact with the corresponding second connection portion or portions 520 without problems.

3) If the second connection portion 520 of the or each ground terminal 500 includes the at least one spring 522, the at least one spring 522 is in elastic contact with the metal casing 10. This arrangement improves reliability of electrical connection between the second connection portion 520 of the or each ground terminal 500 and the metal casing 10.

4) If the first connection portion 510 of the or each ground terminal 500 includes the recessed portion 511*c* and the edge 511*a* of the recessed portion 511*c*, the at least one recessed portion 511*c* fittingly receives the exposed portion of the first portion 101 of the shell 100, and the or each edge 511*a* is stably in contact with the exposed portion of the shell 100. This arrangement increases the reliability of the electrical connection between the or each edge 511*a* and the exposed portion of the shell 100.

5) If the connector C includes the pair of ground terminals 500 and the ground terminals 500 each include the recessed portion 511*c*, the edge 511*a* of the recessed portion 511*c*, and the pair of abutments 513*a* and 513*b*, such arrangement further increases the reliability of the electrical connection between the contact portions 511 of the ground terminals 500 and the shell 100. The ground terminals 500 are stably connected to the shell 100 because the exposed portion of the first portion 101 of the shell 100 is fitted in the recessed portions 511*c* of the ground terminals 500, the edges 511*a* of the recessed portions 511*c* are in contact with the exposed portion of the shell 100, and the abutments 513*a* and 513*b* of one of the ground terminals 500 abut the abutments 513*b* and 513*a*, respectively, of the other ground terminal 500.

6) If the connector C includes the pair of ground terminals 500 and the ground terminals 500 each include the recessed portion 511*c*, the engagement portion 540, and the engagement portion 550, such arrangement further increases the reliability of the electrical connection between the contact portions 511 of the ground terminals 500 and the exposed portion of the shell 100. The ground terminals 500 are stably connected to the shell 100 because the engagement portions

540 and 550 of one of the ground terminals 500 are engaged with the engagement portions 550 and 540, respectively, of the other ground terminal 500, so that the first connection portions 510 of the ground terminals 500 are fixed to each other, sandwiching the exposed portion of the shell 100 in the Z-Z' direction.

The connector and the connection structure described above are not limited to the above embodiments, but they may be modified in any manner within the scope of the claims. Some example variants will now be described.

The shell of the invention is only required to have electrical conductivity and accommodate a body holding at least one terminal. For example, the shell of the invention may include only a first portion having a tubular shape and extending in the Y-Y' direction. In other words, the second portion of the shell may be omitted in the invention. In this case, the body of the invention is only required to be accommodated in the first portion of the shell and hold at least one terminal. The at least one terminal may be connected to a circuit board of an electronic device as described above, or alternatively to a cable. In the latter case, the connector of the invention serves as a plug connector.

The at least one ground terminal of the invention may be integrated with the shell. Such a ground terminal may have substantially the same configuration as a ground terminal 500 of any of the above aspects, except that it is contiguous with the shell, e.g. formed by cutting and raising a part of the shell or alternatively formed contiguously with an end of the shell. The at least one ground terminal of the invention may be connected to a conductive member other than the metal casing and connected to the ground via the conductive member. The first connection portion of the at least one ground terminal of the invention is only required to be accommodated in, and not required to be held by, the at least one accommodation hole in the second portion of the outer body. In other words, the at least one ground terminal of the invention may be securely accommodated in the at least one accommodation hole by being fixed to the outer body outside the accommodation hole. Three or more ground terminals may be provided in the invention. In this case, it is preferable to accordingly provide three or more accommodation holes in the outer body. If the outer body includes at least one accommodation recess and at least one passage, three or more accommodation recesses and three or more passages may also be provided. Adjacent accommodation holes of the three or more accommodation holes may communicate with each other. Adjacent accommodation recesses of the three or more accommodation recesses may communicate with each other.

It should be appreciated that the above embodiments and variants of the connector and the connection structure are described above by way of examples only. The materials, shapes, dimensions, numbers, arrangements, and other configurations of the constituents of the connector and the connection structure may be modified in any manner if they can perform similar functions. The configurations of the embodiments and the variants described above may be combined in any possible manner. The first direction of the invention may be any direction in which the first portion of the outer body of the invention extends. The second direction of the invention may be any direction orthogonal to the first direction.

The present invention can include any combination of these various features or embodiments above and/or below as set-forth in sentences and/or paragraphs. Any combination of disclosed features herein is considered part of the present invention and no limitation is intended with respect to combinable features.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

REFERENCE SIGNS LIST

C: connector
100: shell
101: first portion
110: first shell
111: mounting portion
112: sidewall
120: second shell
130: leg
H: accommodation hole
S: accommodation space
S1: first accommodation space
S2: second accommodation space
200: inner body
201: first portion
202: second portion
300: terminal
301: first portion
302: second portion
400: outer body
401: first portion
402: second portion
410: opening
420: accommodation recess
430: passage
500: ground terminal
510: first connection portion
511: contact portion
511a: edge
511b: flange
511c: recessed portion
512: connection end portion
513a: abutment
513b: abutment
520: second connection portion
521: base
521a: connection end portion
522: spring
530: junction
540: engagement portion
550: engagement portion
10: metal casing

What is claimed is:

1. A connector comprising:

a shell having electrical conductivity;

an inner body made of an insulating resin and disposed inside the shell;

a terminal held by the inner body and disposed inside the shell;

at least one ground terminal; and an outer body made of an insulating resin, the outer body including:

a first portion having a generally tubular shape and extending in a first direction axially with respect to the generally tubular shape;

a second portion; and an accommodation space in the first and second portions, the accommodation space securely accommodating the shell, wherein the second portion has an outer cross-sectional dimension in a second direction, which is larger than an outer cross-sectional dimension of the first portion, the second direction being orthogonal to the first direction, the second portion is provided with at least one accommodation hole, the at least one accommodation hole extending from an outer face of the second portion to the accommodation space, and wherein each ground terminal of the at least one ground terminal includes:

a first connection portion in contact with, or contiguous with, the shell, the first connection portion being accommodated in a respective accommodation hole of the at least one accommodation hole;

a second connection portion on the first portion of the outer body; and a junction extending from the first connection portion to the second connection portion.

2. A connection structure comprising:

the connector according to claim 1; and a metal casing in contact, in the second direction, with the second connection portion of the at least one ground terminal of the connector.

3. A connection structure comprising:

the connector according to claim 1; and a metal casing including a metal plate, wherein the metal plate includes a recess and an edge of the recess, the recess of the metal plate receives therein, in the second direction, a part of the first portion of the outer body and the second connection portion of the at least one ground terminal, and the edge of the metal plate is in contact, in the second direction, with the second connection portion of the at least one ground terminal.

4. The connector according to claim 1, wherein the second portion of the outer body has a wall thickness in the second direction, which is larger than a wall thickness of the first portion of the outer body, in the second direction.

5. The connector according to claim 1, wherein the first connection portion includes:

a contact portion in contact with the shell, and a connection end portion connected to the junction, and the connection end portion is located farther from the shell than the contact portion is.

6. The connector according to claim 5, wherein the at least one accommodation hole comprises a pair of accommodation holes, the at least one ground terminal comprises first and second ground terminals, the first connection portions of the first and second ground terminals are plates extending along the respective accommodation holes, the first connection portions each include:

a recessed portion having a shape and dimensions conforming to substantially the half of an outline of the shell as viewed in cross-section taken in the second direction, an edge of the recessed portion, the edge being in contact with the shell; and a pair of abutments respectively located on opposite sides of the recessed portion, and the abutments of the first ground terminal are in abutment with the abutments of the second ground terminal in the second direction.

7. The connector according to claim 5, wherein the second connection portion is located farther from the shell than the contact portion of the first connection portion is, and closer to the shell than the connection end portion of the first connection portion is.

8. The connector according to claim 7, wherein the at least one accommodation hole comprises a pair of accommodation holes, the at least one ground terminal comprises first and second ground terminals, the first connection portions of the first and second ground terminals are plates extending along the respective accommodation holes, the first connection portions each include:

a recessed portion having a shape and dimensions conforming to substantially the half of an outline of the shell as viewed in cross-section taken in the second direction, an edge of the recessed portion, the edge being in contact with the shell; and a pair of abutments respectively located on opposite sides of the recessed portion, and the abutments of the first ground terminal are in abutment with the abutments of the second ground terminal in the second direction.

9. The connector according to claim 1, wherein the at least one accommodation hole comprises a pair of accommodation holes, the at least one ground terminal comprises first and second ground terminals, the first connection portions of the first and second ground terminals are plates extending along the respective accommodation holes, the first connection portions each include:

a recessed portion having a shape and dimensions conforming to substantially the half of an outline of the shell as viewed in cross-section taken in the second direction, an edge of the recessed portion, the edge being in contact with the shell; and a pair of abutments respectively located on opposite sides of the recessed portion, and the abutments of the first ground terminal are in abutment with the abutments of the second ground terminal in the second direction.

10. The connector according to claim 9, wherein the first ground terminal further includes an engagement portion at the first connection portion of the first ground terminal, the second ground terminal further includes an engagement portion at the first connection portion of the second ground terminal, the engagement portion of one of the first and second ground terminals is provided with an engagement projection, and the engagement portion of the other of the first and second ground terminals is provided with an engagement hole, and the engagement projection is engaged in the engagement hole.

11. The connector according to claim 1, wherein the second connection portion includes a base, and the base is a plate disposed on the first portion of the outer body.

12. The connector according to claim 11, wherein the at least one ground terminal comprises first and second ground terminals, the base of each ground terminal has a shape conforming to an outer shape of substantially a half in the second direction of the first portion of the outer body and includes a first end on one side of a third direction and a second end on the other side of the third direction, the third direction being orthogonal to the first and second directions, and the first end of the base of the first ground terminal abuts the first end of the base of the second ground terminal, and the second end of the base of the first ground terminal abuts the second end of the base of the second ground terminal.

13. A connector comprising:

a shell having electrical conductivity;

an inner body made of an insulating resin and disposed inside the shell;

a terminal held by the inner body and disposed inside the shell;

at least one ground terminal; and an outer body made of an insulating resin, the outer body including:

a first portion having a generally tubular shape and extending in a first direction axially with respect to the generally tubular shape;

a second portion; and an accommodation space in the first and second portions, the accommodation space securely accommodating the shell, wherein the second portion is larger than the first portion in outer cross-sectional dimensions in a second direction and/or in wall thickness in the second direction, the second direction being orthogonal to the first direction, the second portion is provided with at least one accommodation hole, the at least one accommodation hole extending from an outer face of the second portion to the accommodation space, each ground terminal of the at least one ground terminal includes:

a first connection portion in contact with, or contiguous with, the shell, the first connection portion being accommodated in a respective accommodation hole of the at least one accommodation hole, a second connection portion on the first portion of the outer body, and a junction extending from the first connection portion to the second connection portion, and the second connection portion includes:

a base disposed on the first portion of the outer body; and a spring extending from the base such as to be raised in the second direction and away from the first portion, the spring being elastically deformable toward the first portion.

14. The connector according to claim 13, wherein the at least one accommodation hole comprises a pair of accommodation holes, the at least one ground terminal comprises first and second ground terminals, the first connection portions of the first and second ground terminals are plates extending along the respective accommodation holes, the first connection portions each include:

a recessed portion having a shape and dimensions conforming to substantially the half of an outline of the shell as viewed in cross-section taken in the second direction, an edge of the recessed portion, the edge being in contact with the shell; and a pair of abutments respectively located on opposite sides of the recessed portion, and the abutments of the first ground terminal are in abutment with the abutments of the second ground terminal in the second direction.

15. The connector according to claim 13, wherein the spring comprises a plurality of springs having different lengths.

16. The connector according to claim 13, wherein the first connection portion of each of the at least one ground terminal includes:

a contact portion in contact with the shell, and a connection end portion connected to the junction, and the connection end portion is located farther from the shell than the contact portion is.

17. The connector according to claim 16, wherein the at least one accommodation hole comprises a pair of accommodation holes, the at least one ground terminal comprises first and second ground terminals, the first connection portions of the first and second ground terminals are plates extending along the respective accommodation holes, the first connection portions each include:

a recessed portion having a shape and dimensions conforming to substantially the half of an outline of the shell as viewed in cross-section taken in the second direction, an edge of the recessed portion, the edge being in contact with the shell; and a pair of abutments respectively located on opposite sides of the recessed portion, and the abutments of the first ground terminal are in abutment with the abutments of the second ground terminal in the second direction.

18. The connector according to claim 16, wherein the second connection portion of each of the at least one ground terminal is located farther from the shell than the contact portion of the first connection portion is, and closer to the shell than the connection end portion of the first connection portion is.

19. A connector comprising:

a shell having electrical conductivity;

an inner body made of an insulating resin and disposed inside the shell;

a terminal held by the inner body and disposed inside the shell;

a ground terminal; and an outer body made of an insulating resin, the outer body including:

a first portion having a generally tubular shape and extending in a first direction axially with respect to the generally tubular shape;

a second portion; and an accommodation space in the first and second portions, the accommodation space securely accommodating the shell, wherein the second portion is larger than the first portion in outer cross-sectional dimensions in a second direction and/or in wall thickness in the second direction, the second direction being orthogonal to the first direction, the second portion is provided with an accommodation hole, the accommodation hole extending from an outer face of the second portion to the accommodation space, the ground terminal includes:

a first connection portion in contact with, or contiguous with, the shell, the first connection portion being accommodated in the accommodation hole of the outer body, a second connection portion on the first portion of the outer body, and a junction extending from the first connection portion to the second connection portion, the second connection portion includes a base, the base is a plate disposed on the first portion of the outer body, and the first portion of the outer body is provided with an accommodation recess to accommodate the base of the second connection portion of the ground terminal.

20. A connection structure comprising:

a connector that comprises:

a shell having electrical conductivity;

an inner body made of an insulating resin and disposed inside the shell;

a terminal held by the inner body and disposed inside the shell;

at least one ground terminal; and an outer body made of an insulating resin, the outer body including:

a first portion having a generally tubular shape and extending in a first direction axially with respect to the generally tubular shape;

a second portion; and an accommodation space in the first and second portions, the accommodation space securely accommodating the shell, wherein the second portion has an outer cross-sectional dimension in a second direction, which is larger than an outer cross-sectional dimension of the first portion, the second direction being orthogonal to the first direction, the second portion is provided with at least one accommodation hole, the at least one accommodation hole extending from an outer face of the second portion to the accommodation space, the at least one ground terminal is in contact with, or contiguous with, the shell and is disposed in the at least one accommodation hole of the outer body, and the at least one ground terminal includes a portion that is exposed from the outer body or partly located outside the outer body; and a metal casing in contact with the at least one ground terminal of the connector.

* * * * *